US011378351B2

(12) United States Patent
Liao

(10) Patent No.: US 11,378,351 B2
(45) Date of Patent: Jul. 5, 2022

(54) CUTTING-POWER-OFF DETECTION STRUCTURE OF TOY GUN

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 56 days.

(21) Appl. No.: 17/022,099

(22) Filed: Sep. 16, 2020

(65) Prior Publication Data

US 2022/0082351 A1 Mar. 17, 2022

(51) Int. Cl.

| | |
|---|---|
| ***F41B 11/71*** | (2013.01) |
| ***F41B 11/89*** | (2013.01) |
| ***F41A 17/06*** | (2006.01) |
| ***F41B 11/643*** | (2013.01) |

(52) U.S. Cl.

CPC ..... *F41B 11/71* (2013.01); *F41B 11/643* (2013.01); *F41B 11/89* (2013.01)

(58) Field of Classification Search

CPC ..... F41B 11/57; F41B 11/643; F41B 11/71; F41B 11/89; F41A 17/06; F41A 17/36; F41A 17/32

USPC ..... 124/32, 54, 77, 71

See application file for complete search history.

(56) References Cited

U.S. PATENT DOCUMENTS

| | | | | |
|---|---|---|---|---|
| 5,826,360 | A * | 10/1998 | Herold | F41A 9/62 42/1.02 |
| 7,624,727 | B2 * | 12/2009 | Campo | F41B 11/71 124/32 |
| 11,069,227 | B1 * | 7/2021 | Hubatka | F41A 19/01 |
| 2010/0154766 | A1 * | 6/2010 | Skilling | F41B 11/71 124/71 |
| 2011/0283984 | A1 * | 11/2011 | Hu | F41B 11/642 124/77 |
| 2014/0373823 | A1 * | 12/2014 | Stevens | F41B 11/51 124/56 |
| 2015/0176942 | A1 * | 6/2015 | Hu | F41B 11/57 124/32 |
| 2015/0377582 | A1 * | 12/2015 | Kang | F41B 11/89 124/71 |
| 2017/0328670 | A1 * | 11/2017 | Liao | F41B 11/89 |
| 2021/0041206 | A1 * | 2/2021 | Wood | F41B 11/71 |

* cited by examiner

*Primary Examiner* — Alexander R Niconovich
(74) *Attorney, Agent, or Firm* — Leong C. Lei

(57) ABSTRACT

A cutting-power-off detection structure of a toy gun has a main structure that includes a gun body, a muzzle defined at one side of the gun body, a feeding channel defined in the gun body, a chamber defined in the gun body and in communication with the muzzle and the feeding channel, a circuit device arranged in the gun body, at least one wireless detection device arranged in the gun body and electrically connected with the circuit device, and a shot forwarding device arranged in the chamber and electrically connected with the circuit device. The feeding channel is connectable to a magazine and the wireless detection device is operable to detect a shot fed from the magazine. When the magazine runs out of shots and the wireless detection device detects no shot, a signal is transmitted to the circuit device to cut off electricity supplied to the shot forwarding device.

9 Claims, 7 Drawing Sheets

CUTTING-POWER-OFF DETECTION STRUCTURE OF TOY GUN

TECHNICAL FIELD OF THE INVENTION

The present invention relates to a cutting-power-off detection structure of a toy gun, and more particularly to a cutting-power-off detection structure of a toy gun that simulates the mechanism of firing of a real gun in an out-of-ammunition condition, reduces power consumption and frictional loss, and requires no special-purpose magazine to achieve power cut-off in case of out-of-ammunition.

DESCRIPTION OF THE PRIOR ART

A toy gun is a toy that has an outside appearance that looks like a gun or fire arm. Some are powered by electrical batteries, so that when a trigger is pulled, a sound-lighting effect will be generated, while the others use pressurized air or a minor amount of gun powder to shoot plastic bullets that are less lethal.

Among these toys, those that are driven by electrical power are commonly referred to as "electrical guns", in which shooting is carried out in such a way that a motor is operable to drive a gearbox to cause a piston pump to compress a spring and an operation automatic loading is repeatedly and cyclically performed with the gearbox. In this way, bullets can be shot out by pneumatic pressure and an effect of simulating firing of a real gun is achieved.

The known electrical guns, however, suffer certain drawbacks, which are discussed below, and further improvement is required.

Firstly, because of the motor has not been de-energized, most of the toy guns continue to operate even if there is no bullet in the magazine, making it impossible to simulate the mechanism of firing of a real gun in a condition of running out of ammunition.

Secondly, the continuous operation of the motor after the magazine has run out of bullet causes a waste of electrical power and may even cause damage to parts thereof.

Thirdly, out-of-ammunition power-cutting arrangements that have been proposed and are currently known all need to work with special-purpose or dedicated magazines having a feature of bullet ejecting, and no detection of whether there is still bullets remaining in the chamber may be carried out unless such a special-purpose magazine is used.

Fourthly, the out-of-ammunition power-cutting structures that are known applies a means of pushing and contacting to detect whether there is still a bullet remaining in the magazine, and this would cause damage to the parts due to friction and abrasion for long-term use.

SUMMARY OF THE INVENTION

The primary objective of the present invention is that a wireless detection device is arranged in a gun body to carry out detection of a forward-conveyed bullet in order to achieve an effect of automatically cutting off power when there is no bullet remaining in a magazine and thus reducing power consumption and abrasion caused by friction and also simulating mechanism of firing of a real gun in case of running out of ammunition.

To achieve the above objective, the present invention has a main structure that comprises: a gun body, the gun body having one side that defines a muzzle, a feeding channel and a chamber being defined in an interior of the gun body, the chamber being in communication with the muzzle and the feeding channel, the gun body being also provided, in the interior thereof, with a circuit device and at least one wireless detection device, the wireless detection device being electrically connected with the circuit device, the wireless detection device being located at one side of the feeding channel and the chamber, a shot forwarding device being arranged at one side of the chamber that is opposite to the muzzle, the shot forwarding device being electrically connected with the circuit device, one side of the shot forwarding device being adjacent to the wireless detection device.

With the above structure, a user may use the feeding channel to connect with a magazine, such that when the user pulls the trigger, the shot forwarding device located in the chamber is caused to move backward, namely moving in a direction toward one side of the feeding channel that is distant from the muzzle to have the magazine feeds shots to an interfacing site between the feeding channel and the chamber. Under such a condition, the wireless detection device carries out detection on such a site, and a detection of an object indicates there are shots still remaining therein. Thus, the shot forwarding device continues the operation. When the shots are used up and the user still pulls the trigger to cause the shot forwarding device to move backward, the wireless detection device does not detect any shot, and therefore transmits a signal to the circuit device indicating no shot remains in the magazine to have the circuit device cut off power supplied to the shot forwarding device.

As such, an effect of cutting off power in case of being out of ammunition can be achieved without adopting a special-purpose magazine, and it is possible to simulate the mechanism of firing a real gun in a condition of being out of ammunition and also to reduce loss of electrical power, and further, the wireless detection structure of the wireless detection device also provides an effect of reducing loss caused by friction and abrasion.

With the above-described technology, it is possible to break through the problems of the known electrical gun that it is not possible to simulate the mechanism of firing of a real gun in a condition of being out of ammunition, that it may easily lead to damage of parts, that it may cause waste of electrical energy, and that cutting of power in a condition of being out of ammunition relies on adoption of a special-purpose magazine, to thereby achieve improvement of practical applications.

DETAILED DESCRIPTION OF THE PREFERRED EMBODIMENT

Figure 1:
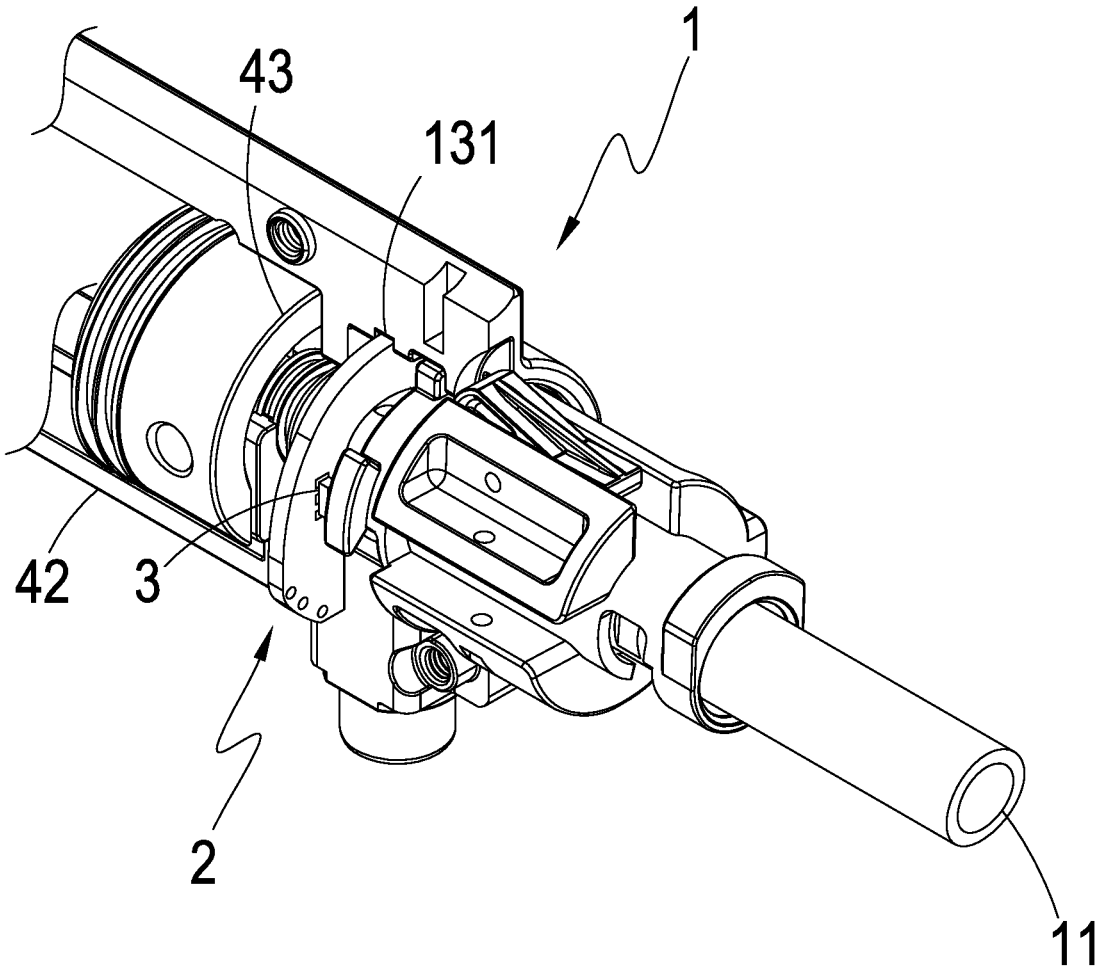
FIG. 1 is a perspective view of the present invention.
Figure 2:
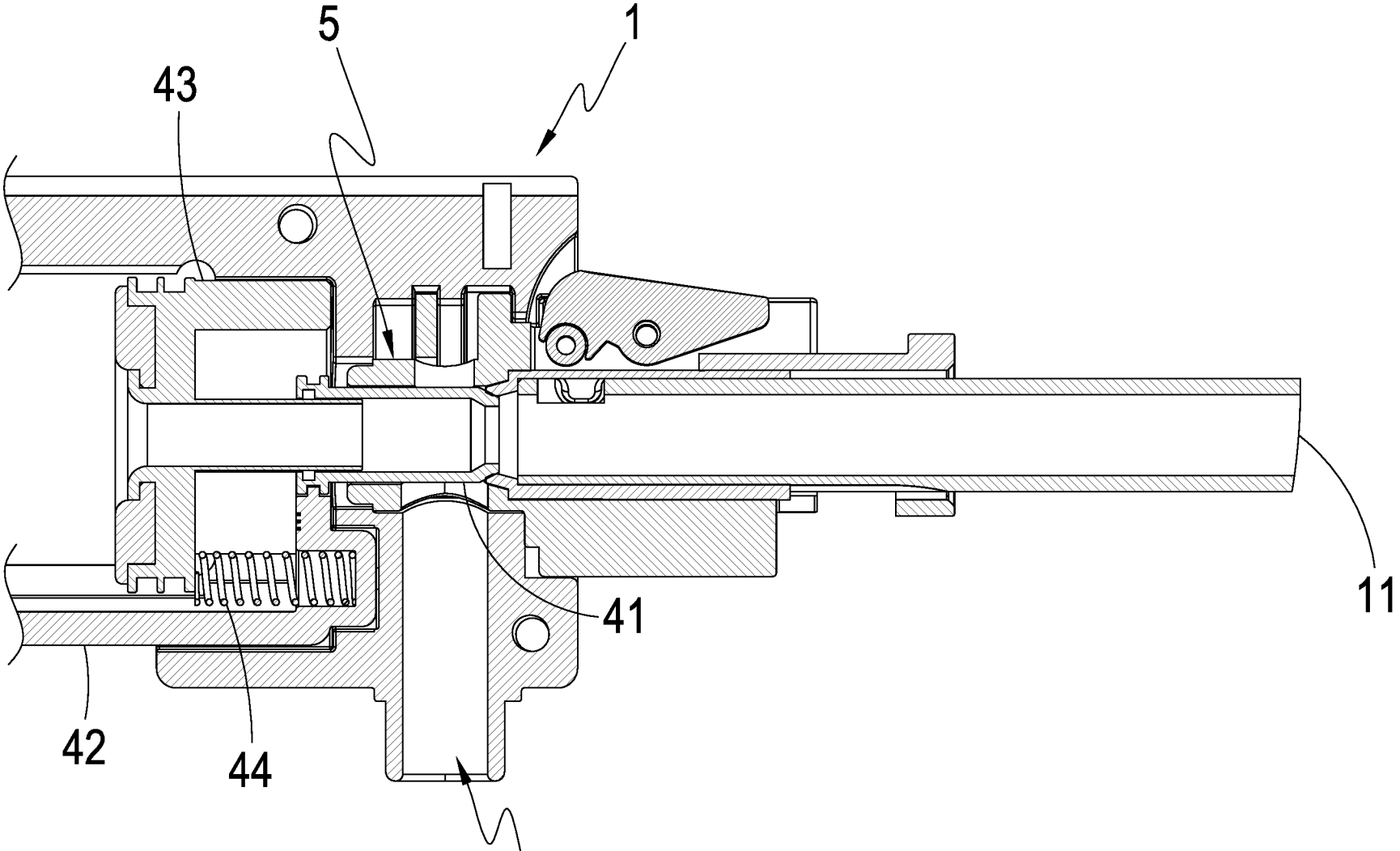
FIG. 2 is a cross-sectional view of the present invention.
Figure 3:
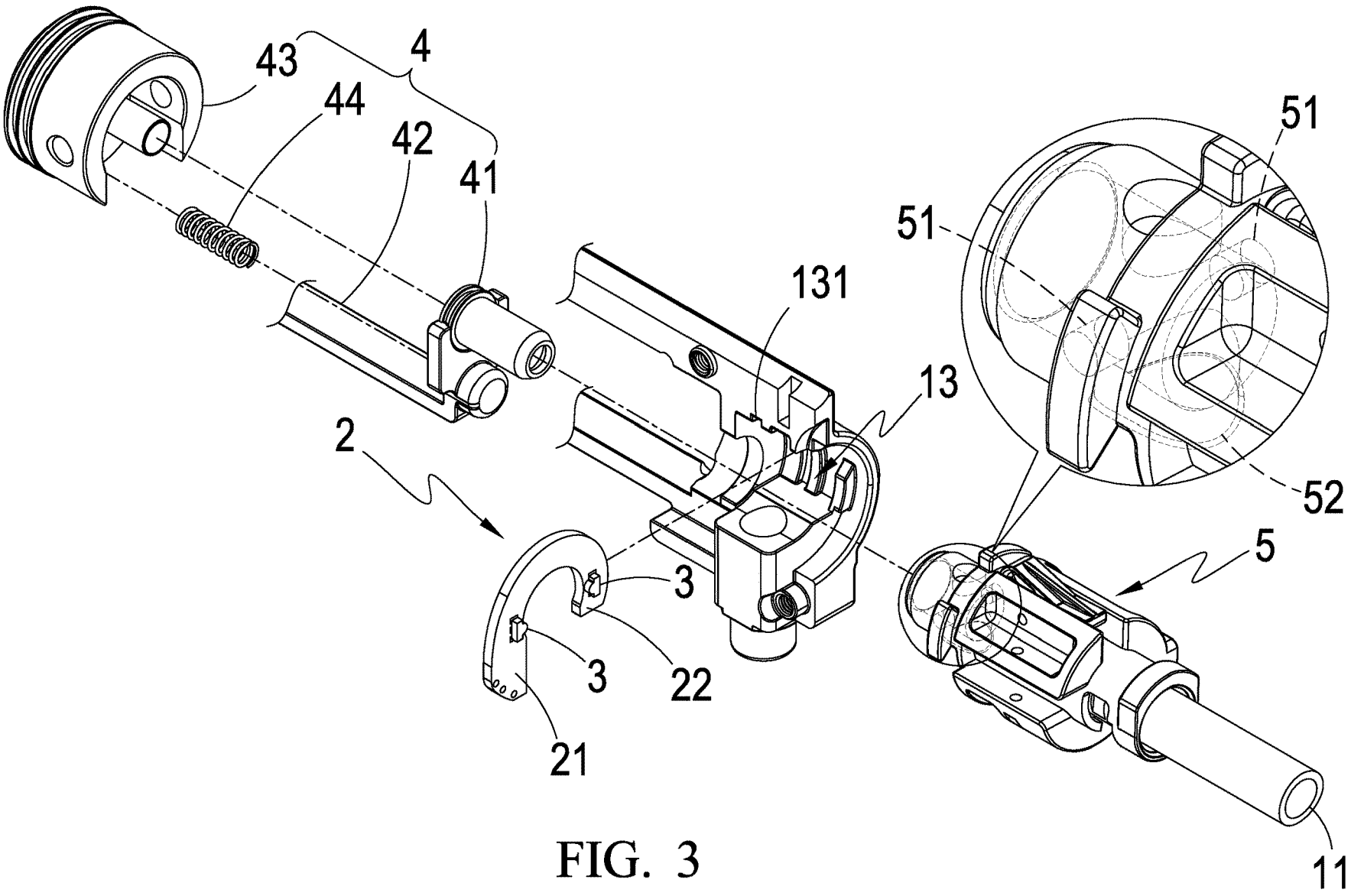
FIG. 3 is an exploded view of the present invention.
Figure 4:
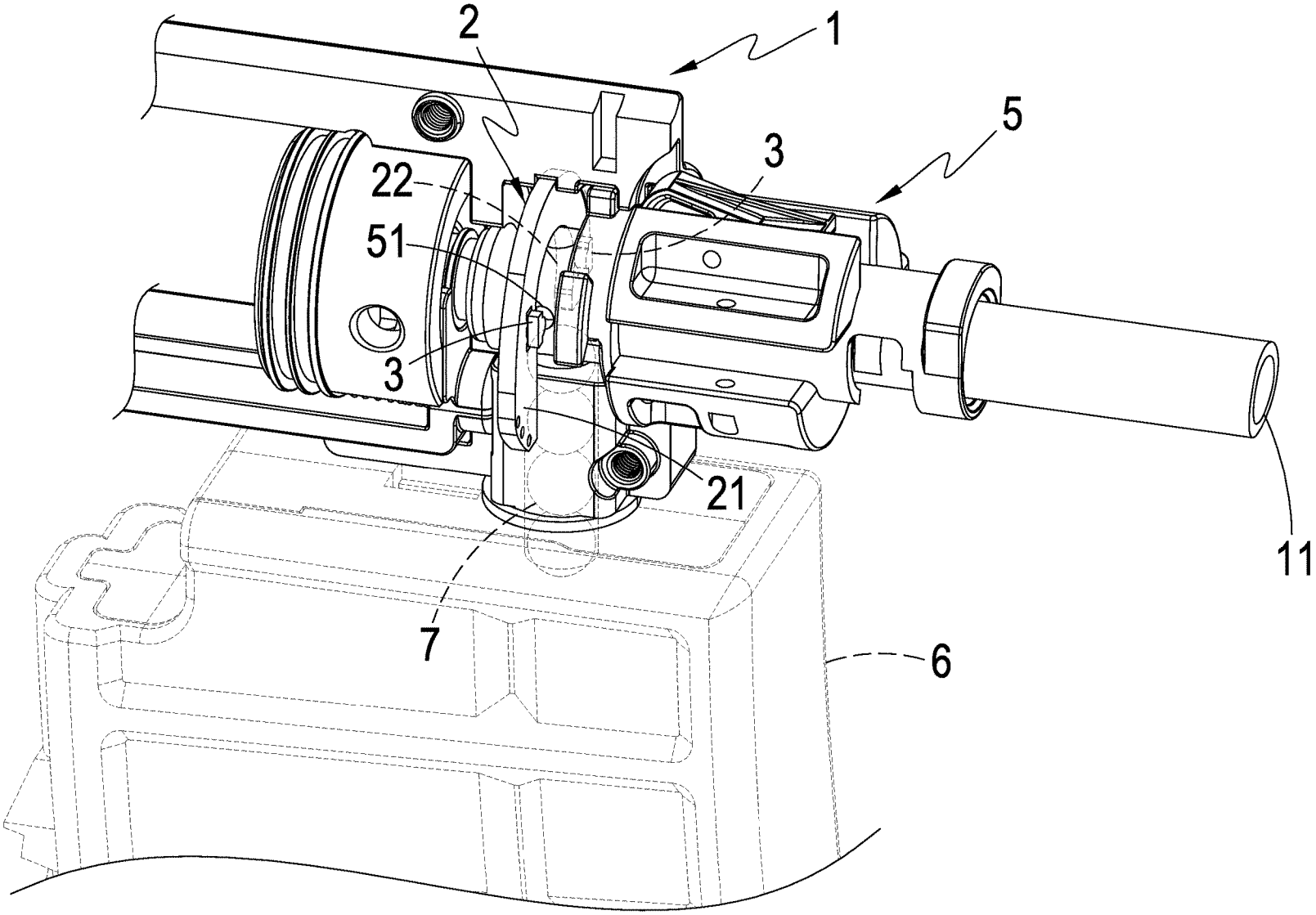
FIG. 4 is a schematic view illustrating triggering according to the present invention.
Figure 5:
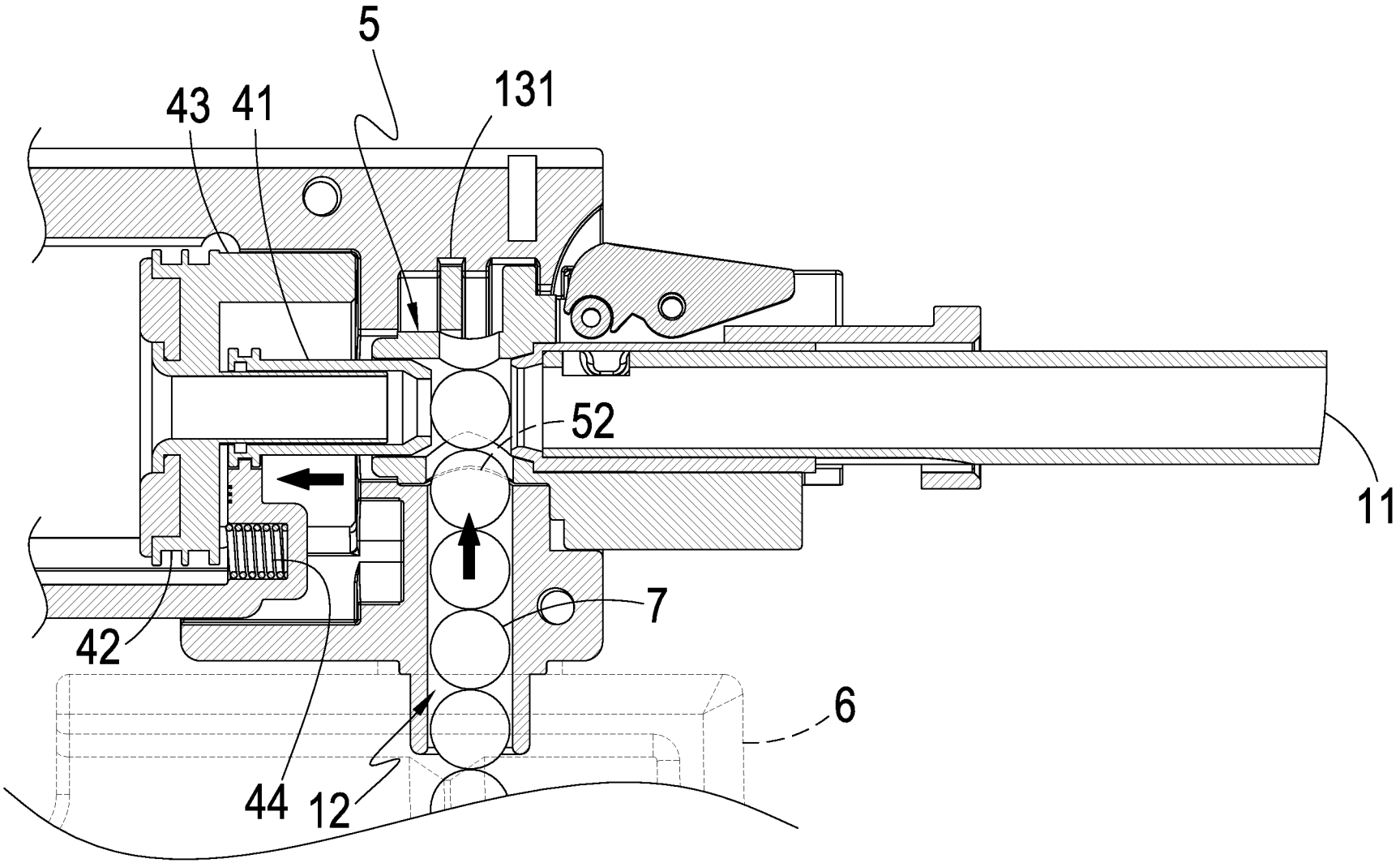
FIG. 5 is a schematic view illustrating compressing according to the present invention.
Figure 6:
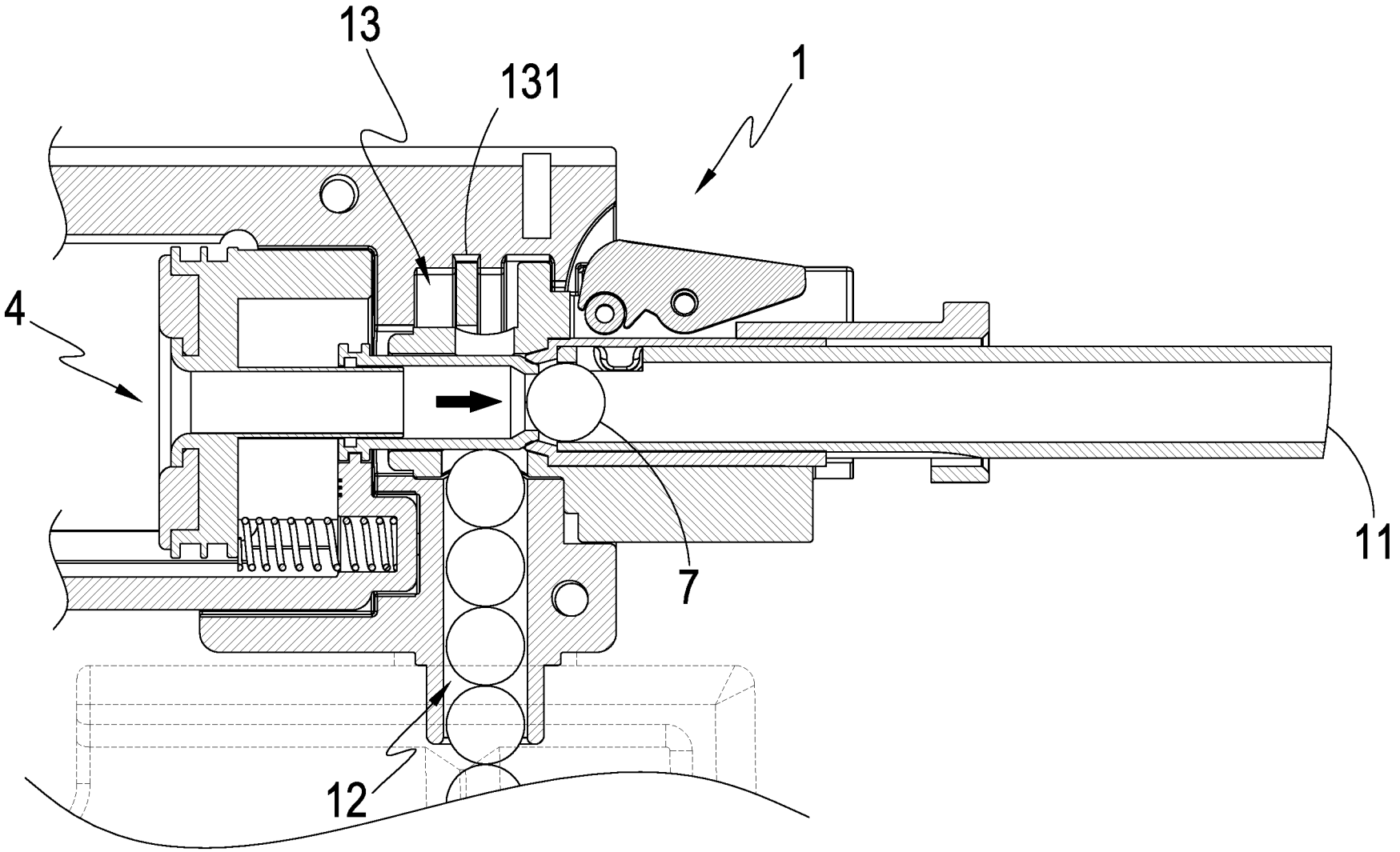
FIG. 6 is a schematic view illustrating firing according to the present invention.
Figure 7:
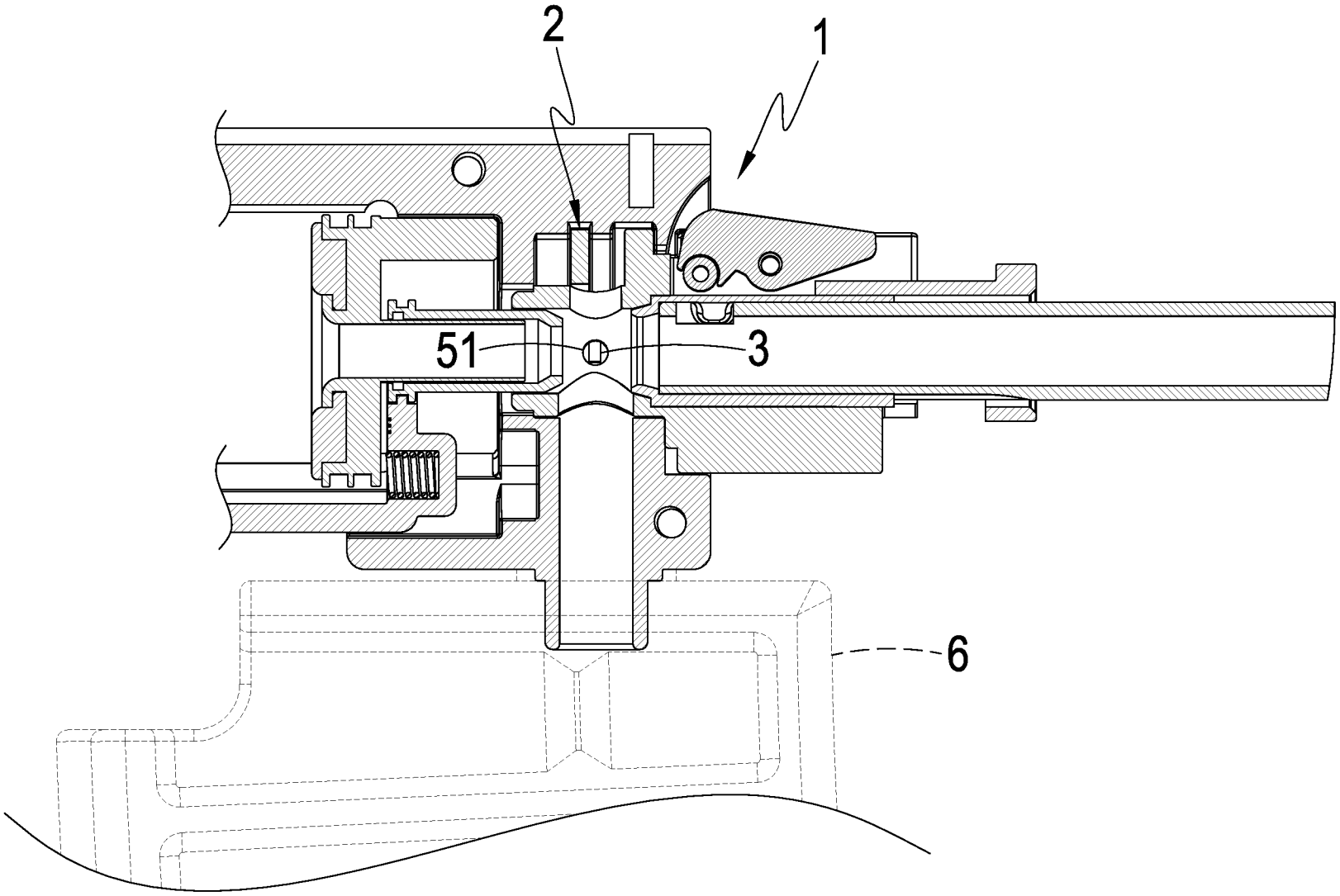
FIG. 7 is a schematic view illustrating power cutting according to the present invention.

Referring to FIGS. 1-3, which are respectively a perspective view, a cross-sectional view, and an exploded view of the present invention, these drawings clearly show that the present invention comprises:

a gun body 1, the gun body 1 having one side that defines a muzzle 11;

a feeding channel 12, the feeding channel 12 being defined in an interior of the gun body 1, the feeding channel 12 being connected to a magazine;

a chamber 13, the chamber 13 being defined in the interior of the gun body 1 and in communication with the muzzle 11 and the feeding channel 12;

a circuit device 2, the circuit device 2 being arranged in the gun body 1;

at least one wireless detection device 3, the wireless detection device 3 being arranged in the gun body 1 and electrically connected with the circuit device 2, the wireless detection device 3 being located at one side of the feeding channel 12 and the chamber 13 to detect a plurality of shots or bullets forwarded from the magazine; and a shot forwarding device 4, the shot forwarding device 4 being arranged at one side of the chamber 13 that is opposite to the muzzle 11 and electrically connected with the circuit device 2, one side of the shot forwarding device 4 being adjacent to the wireless detection device 3.

Preferably, the circuit device 2 is arranged at one side of the feeding channel 12 and the chamber 13 and being located at interfacing between the feeding channel 12 and the chamber 13 is taken as an example for illustration.

Preferably, the circuit device 2 comprises a printed circuit board.

Preferably, the wireless detection device 3 comprises an infrared interruption sensor.

Preferably, in the instant embodiment, an electrical gun is taken as an example of the toy gun for illustration.

In the instant embodiment, the circuit device 2 is provided, at one side thereof, with a first coupling arm 21 and is also provided, at an opposite side thereof, with a second coupling arm 22, so that the circuit device 2 shows an inverted U-shaped configuration. As an example of illustration, two such wireless detection devices 3 are provided and are respectively arranged on the first coupling arm 21 and the second coupling arm 22.

In the instant embodiment, the shot forwarding device 4 comprises a shot pushing member 41, a driving member 42 connected to one side of the shot pushing member 41 that is distant from the muzzle 11, a blocking member 43 arranged at one side of the driving member 42, and an elastic member 44 having two sides respectively abutting the driving member 42 and the blocking members 43. A spring is taken as example of the elastic member 44 for illustration.

In the instant embodiment, the chamber 13 is provided with a constraining slot 131 that is formed therein at a location corresponding to the circuit device 2.

In the instant embodiment, the chamber 13 is provided therein with a constraining member 5 that corresponds, in position, to the shot forwarding device 4. The constraining member 5 is provided with at least one detection through-hole 51, which corresponds, in position, to the wireless detection device 3 and a feeding through-hole 52, which corresponds, in position, to the feeding channel 12.

The structure of the present invention can be understood from the description provided above, and based on corresponding combination of the above structure, power can be automatically cut off even no special-purpose magazine is involved, in order to generate the mechanism of firing of a real gun when there is no bullets or shots, and also to reduce losses concerning electrical power and friction. A detailed description will be provided below.

Referring to FIGS. 1-7, which are respectively a perspective view, a cross-sectional view, and an exploded view of the present invention and schematic views illustrating triggering, compressing, firing, and power cutting according to the present invention, with the above-described structure being assembled and combined, these drawings clearly show that to use the present invention, the feeding channel 12 of the gun body 1 is first connected to the magazine 6, and a spring arranged inside the magazine 6 pushes shots 7 upward to have an uppermost one of the shots 7 to abut and contact a lower side of the shot pushing member 41 of the shot forwarding device 4, and under such a condition, the shot pushing member 41 blocks the shots 7 from moving through the feeding channel 12 to enter the chamber 13 through, this being a blocked state.

With the structure of the electrical gun, when a user pulls a trigger, a motor is caused to rotate and drives a gear to rotate, so as to cause, by means of gear-rack transmission, the driving member 42 to displace backward. Since the shot pushing member 41 is connected to the driving member 42, the shot pushing member 41 is moved backward in unison therewith, and the shots 7 located in the magazine 6 are no longer blocked by the shot pushing member 41 and are biased or pushed by the spring inside the magazine 6 into the chamber 13 to be located between the two wireless detection devices 3.

At the same time when the shot pushing member 41 is moved backward, the wireless detection devices 3 are put into operation. According to the description of the instant embodiment provided above that the wireless detection devices 3 are infrared interruption sensors and the number is two, one of which functions to transmit an infrared signal and the other one receives the infrared signal, when signal transmission between the two wireless detection devices 3 is blocked and interrupted, it indicates there are shots 7 remaining in the magazine 6, and as such, the shot forwarding device 4 continues to operate.

When the driving member 42 moves the shot pushing member 41 backward to a dead point, since the elastic member 44 is set abutting the structure of the blocking members 43, the shot pushing member 41 is elastically returned back into the chamber 13 to get into contact with a shot 7 that is moved through the feeding channel 12 into the chamber 13, forcing the shot 7 to move into a gun barrel to complete a loading operation. Subsequently, a piston is put into operation to compress air to pass through the shot pushing member 41 to shoot the shot 7 out of the muzzle 11.

When the magazine 6 runs out of shots 7, if the user pulls the trigger again, the shot pushing member 41 is operated in the same way as described to move backward and the wireless detection devices 3 are also in operation for making detection at the site of the chamber 13. However, since there is no shot 7 remaining in the magazine 6, when the shot pushing member 41 is moved backward, there is no object to cause interruption between the two wireless detection devices 3, so that the infrared signal is allowed to transmit from one side to the opposite side, making the wireless detection devices 3 determine there is no shot 7 remaining in the magazine 6, and an out-of-ammunition signal is transmitted to the circuit device 2, such that the circuit device 2 cuts off the electrical power supplied to the shot forwarding device 4 and the motor, thereby stopping the operation of the shot forwarding device 4 and the motor, and thus achieving an effect of cutting power off.

The operation of trigger pulling and firing of shots 7 described above involves only a structure of a known electrical gun, and thus, the drawings are prepared to disclose the key features of the present invention. Based on the above-described structure of the wireless detection devices 3 being arranged in the gun body 1, an effect of cutting power off in case of being out of ammunition can be achieved without adopting a magazine of a special specification featuring bullet abutting, in order to simulate mechanism of firing of a real gun in a condition of being out of ammunition and also to avoid waste of electrical power. Further, due to the wireless detection arrangement, a detection operation can always be performed without direct contact with a shot or bullet 7, and this reduce loss resulting from friction and abrasion and thus helps improves overall lifespan.

In the instant embodiment, the first coupling arm 21 and the second coupling arm 22 of the circuit device 2 being adhesively mounted to the gun body 1 is provided as an example. The first coupling arm 21 and the second coupling arm 22 arranged to set the circuit device 2 in an inverted U-shaped configuration, allowing the circuit device 2 to be arranged in the chamber 13 and straddling on and spanning over the shot pushing member 41. As such, the wireless detection device 3 can be directly arranged on the circuit device 2 at one side of the feeding channel 12 without the need to additionally provide extra wires, thereby improving overall convenience of use.

In the instant embodiment, the constraining slot 131 is structured to constrain or limit the position of the circuit device 2, in order to have the circuit device 2 securely fix in the gun body 1. A curved or arc groove that matches a curving side line of the circuit device 2 is taken as an example of the constraining slot 131 for illustration.

In the instant embodiment, the constraining member 5 is structured to constrain or limit the position of the shot pushing member 41. A tubular body that houses the outside of the shot pushing member 41 is taken as an example of the constraining member 5 for securely holding the shot pushing member 41 to carry out pushing operations. The structural arrangement that the detection through-hole 51 is provided in the constraining member 5 at a location corresponding to the wireless detection device 3 is to prevent the infrared signal emitting from the wireless detection device 3 from being blocked and interrupted by the constraining member 5. Further, the structural arrangement of the feeding through-hole 52 provided in the constraining member 5 is such that the shots 7 from the feeding channel 12 are allowed to pass through the feeding through-hole 52 to enter the chamber 13, avoiding the shots 7 being blocked by the constraining member 5.

Thus, the cutting-power-off detection structure of the toy gun according to the present invention provides the following key features for improving the prior art:

Firstly, the structural arrangement of the wireless detection device 3 allows detection of shots 7 remaining in the magazine 6, so that power will be cut off at the time when the trigger is pulled while no shot 7 remains in the magazine 6, to thereby simulate the mechanism of firing of a real gun in a condition of being out of ammunition, and also to reduce unnecessary waste of electrical power.

Secondly, the structural arrangement of the wireless detection device 3 being arranged in the gun body 1, an effect of cutting power off in case of being out of ammunition can be realized with a regular magazine 6, without adopting a magazine of a special specification featuring bullet abutting.

Thirdly, the structural arrangement of wireless detection of the wireless detection device 3 helps reduce loss resulting from friction and abrasion to thereby improve overall lifespan.

Fourthly, the structural arrangement of the circuit device 2 having the first coupling arm 21 and the second coupling arm 22 allows the circuit device 2 to be arranged in the chamber 13 and straddling on and spanning over the shot pushing member 41, allowing the wireless detection device 3 to be arranged on the circuit device 2, without the need of involving extra electrical wires.

I claim:

1. A cutting-power-off detection structure of a toy gun, comprising:

a gun body, the gun body having one side that defines a muzzle;

a feeding channel, the feeding channel being defined in an interior of the gun body, the feeding channel being connected to a magazine;

a chamber, the chamber being defined in the interior of the gun body and in communication with the muzzle and the feeding channel;

a circuit device, the circuit device being arranged in the gun body;

at least one wireless detection device, the wireless detection device being arranged in the gun body and electrically connected with the circuit device, the wireless detection device being located at one side of the feeding channel and the chamber to detect a plurality of shots or bullets forwarded from the magazine; and a shot forwarding device, the shot forwarding device being arranged at one side of the chamber that is opposite to the muzzle and electrically connected with the circuit device, one side of the shot forwarding device being adjacent to the wireless detection device, wherein the chamber is provided therein with a constraining member that corresponds in position to the shot forwarding device.

2. The cutting-power-off detection structure of the toy gun according to claim 1, wherein the circuit device is arranged at one side of the feeding channel and the chamber.

3. The cutting-power-off detection structure of the toy gun according to claim 2, wherein the wireless detection device is arranged on the circuit device.

4. The cutting-power-off detection structure of the toy gun according to claim 2, wherein the circuit device comprises a first coupling arm formed at one side thereof and the circuit device comprises a second coupling arm formed at one side thereof that is opposite to the first coupling arm.

5. The cutting-power-off detection structure of the toy gun according to claim 1, wherein the chamber is provided with a constraining slot formed therein at a location corresponding to the circuit device.

6. The cutting-power-off detection structure of the toy gun according to claim 1, wherein the constraining member is formed therein with at least one detection through-hole that corresponds in position to the wireless detection device and a feeding through-hole that corresponds in position to the feeding channel.

7. The cutting-power-off detection structure of the toy gun according to claim 1, wherein the shot forwarding device comprises a shot pushing member, a driving member connected to one side of the shot pushing member that is distant from the muzzle, a blocking member arranged at one side of the driving member, and an elastic member having two sides respectively abutting the driving member and the blocking member.

8. The cutting-power-off detection structure of the toy gun according to claim 1, wherein at least one wireless detection device comprises two wireless detection devices.

9. The cutting-power-off detection structure of the toy gun according to claim 1, wherein the wireless detection device comprises an infrared interruption sensor.

* * * * *